US009402777B1

(12) United States Patent
Birnbaum

(10) Patent No.: US 9,402,777 B1
(45) Date of Patent: Aug. 2, 2016

(54) UNDERARM SHOCK ABSORBER FOR CRUTCHES

(71) Applicant: Bernardo Birnbaum, Aventura, FL (US)

(72) Inventor: Bernardo Birnbaum, Aventura, FL (US)

( * ) Notice: Subject to any disclaimer, the term of this patent is extended or adjusted under 35 U.S.C. 154(b) by 0 days.

(21) Appl. No.: 14/603,768

(22) Filed: Jan. 23, 2015

(51) Int. Cl.
*A61H 3/02* (2006.01)

(52) U.S. Cl.
CPC ..... *A61H 3/02* (2013.01); *A61H 3/0277* (2013.01)

(58) Field of Classification Search
CPC ..... A61H 3/0277; A61H 3/02
USPC ..... 248/576; 135/68, 73
See application file for complete search history.

(56) References Cited

U.S. PATENT DOCUMENTS 1,241,815 A 10/1917 Blackard
1,495,865 A * 5/1924 Moore ..... A61H 3/02 135/68
2,364,053 A 12/1944 Bourne
2,398,247 A * 4/1946 Redcliffe ..... A61H 3/02 135/69
2,515,798 A * 7/1950 Thomas ..... A61H 3/02 135/73
2,856,943 A * 10/1958 Sparlin ..... A61H 3/0277 135/68
4,637,414 A * 1/1987 Urban ..... A61H 3/02 135/73
2002/0144723 A1 * 10/2002 Zulla ..... A61H 3/0277 135/71

* cited by examiner

*Primary Examiner* — Anita M King
(74) *Attorney, Agent, or Firm* — Jesus Sanchelima, Esq.; Christian Sanchelima, Esq.

(57) ABSTRACT

An underarm shock absorber assembly 10 mounted to one end of a crutch stick providing calibrated support to a user. The different portions of the saddle assembly 30 ergonomically conform to a user's underarm and the compression of springs 47 is selected depending on a user's gait and preferences. Assembly 10 is mounted substantially perpendicularly to an underarm crutch stick with a truss assembly 20 having through openings 26 and sockets 42 mounted to support assembly 40 pass through through openings 26 housing spring members 47. Saddle assembly 30 includes supporting plates 31 with posts 32 having distal counterbored end 132 to which tubes 36 are mounted at one end. The other end of tubes 36 coacts with spring members 47.

4 Claims, 6 Drawing Sheets

UNDERARM SHOCK ABSORBER FOR CRUTCHES

BACKGROUND OF THE INVENTION

1. Field of the Invention

The present invention relates to crutches and, more particularly, to crutches with an underarm shock absorber mechanism that smoothly transmits a portion of a user's weight to the body of the crutch member.

2. Description of the Related Art

Several designs for crutches have been designed in the past. None of them, however, include an ergonomic shock absorber that comfortably conforms to a user's underarm to gradually absorb a portion of the weight of a user to be transmitted through the crutch.

Applicant believes that a related reference corresponds to U.S. Pat. No. 2,364,053 issued to J. Bourne for a crutch. However, it differs from the present invention because the crutch discloses a saddle member 14 that is rigid to support studs 16. This rigid engagement coacts with all springs 17 simultaneously. On the other hand, the present invention includes independent spring members that gradually absorb the weight of a user. Being independent, the spring in the present invention can be adjusted or selected to increase or decrease their compression force depending on a user's gait.

Similarly, in U.S. Pat. No. 1,241,815 for another crutch device, issued to Blackard, a plate 12 is shown acting on springs 13 that act simultaneously. In contrast, the present invention permits a user to apply his/her weight against the compression force of each spring independently. The characteristics of each spring are selected to present different magnitudes of spring compression forces. As the user begins to apply his/her weight, the point where the maximum portion of his/her weight to be applied is reached and then starts removing his/her weight as the user advances his/her aided step. With the prior art crutches, the entire combined spring force is presented to a user at all times resulting in an uncomfortably strong spring resistance for the beginning, during and end of a user's aided step.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a crutch with a saddle assembly that gradually absorbs a portion of a user's weight, as needed, for minimum discomfort.

It is another object of this invention to provide a saddle assembly that permits a user to select the magnitude of the spring compression forces to be applied at different stages of the aided step.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
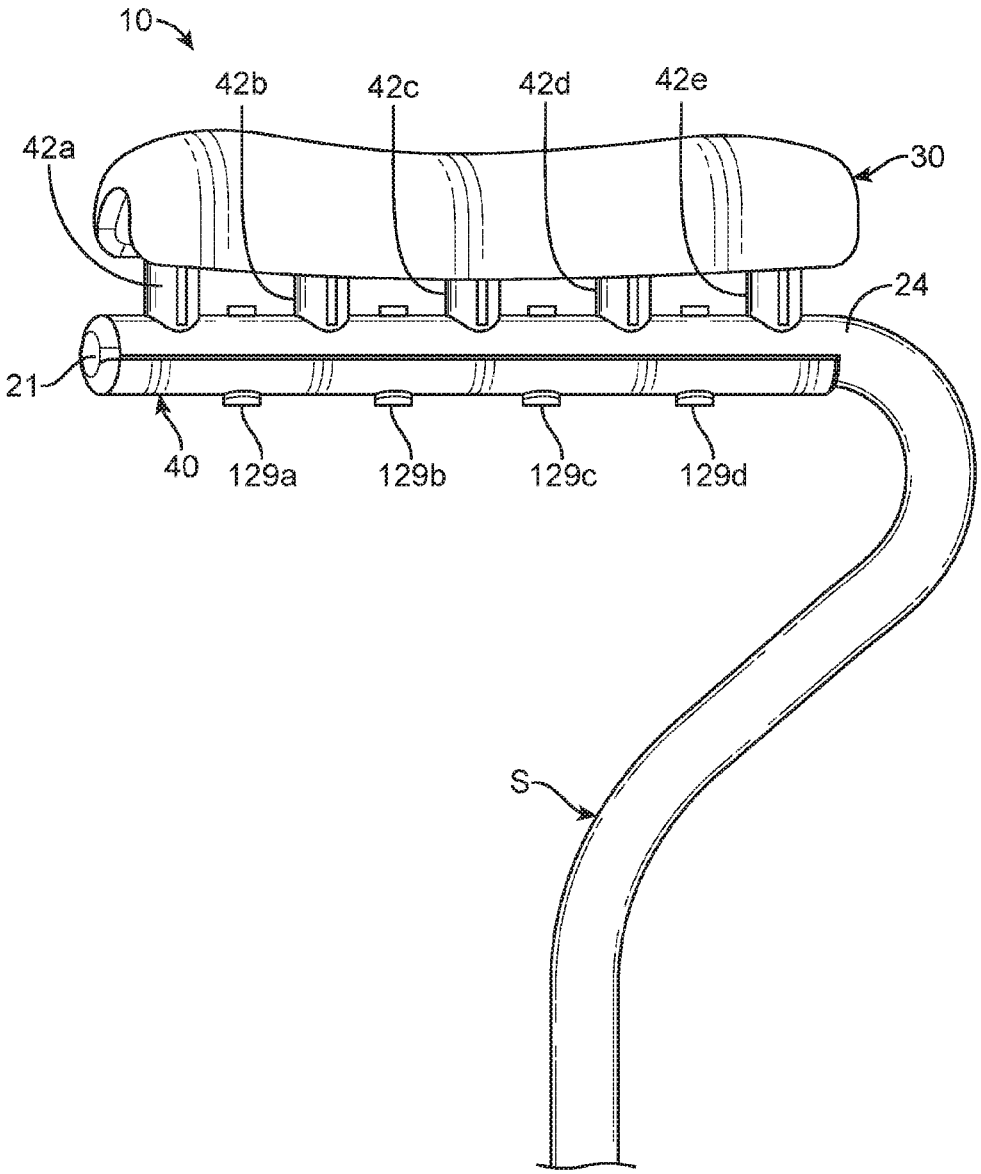
FIG. 1 represents an inclined elevational view of a crutch underarm shock absorber incorporating the present invention.

Referring now to the drawings, where the present invention is generally referred to with numeral 10, it can be observed that it basically includes arm truss assembly 20, saddle assembly 30 and supporting assembly 40. Underarm shock absorber for crutches 10 is rigidly mounted to crutch stick S, substantially perpendicularly thereto.

Arm truss assembly 20 includes ends 21 and 24. Assembly 20 extends a predetermined distance, substantially straight, as seen FIG. 1. In one of the preferred embodiments, such as the one illustrated in these figures, truss assembly 20 includes five through openings 26*a* through 26*e*, as best seen in FIG. 2. In this application, the use of letter subscripts denotes specific components. If no subscripts are used it will be understood to relate to similar components addressed in general. Also, through holes 27*a* through 27*d*, four of them in this embodiment, are located between adjacent through openings 26*a* through 26*e*. Truss assembly 20 is made out of a rigid material, and preferably light, such as aluminum. Elongated concave support assembly 40 is substantially coextensive with truss assembly 20 and includes through apertures 28*a* through 28*d* that are cooperatively aligned with holes 27*a* through 27*d*. In the preferred embodiment shown in these drawings through apertures 28 include sockets 128*a* through 128*d* for receiving nuts 129*a* through 129*d*. Bolts 23*a* through 23*c* pass through through holes 27*a* through 27*d* and through through openings 28*a* through 28*d* to be matingly received by nuts 29*a* through 29*d*.

Figure 4:
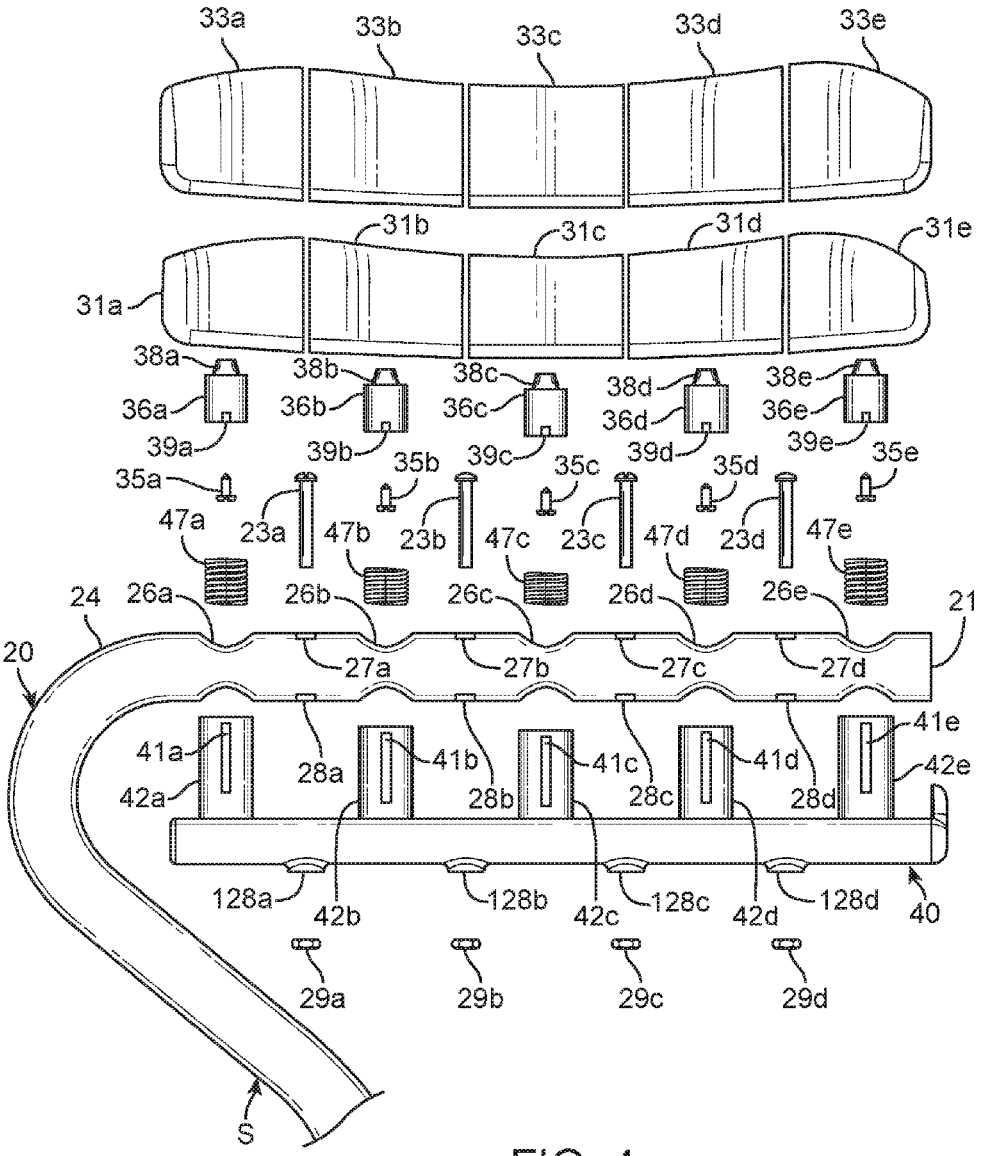
FIG. 4 is an exploded view showing the different components of underarm shock absorber 10.

Supporting assembly 40 longitudinally receives truss assembly 20. Sockets 42*a* through 42*e* are perpendicularly mounted to the concave side of assembly 40 and have cooperative dimensions to pass trough through openings 26*a* through 26*e* and protruding through truss member 21 a predetermined distance. These components can be best seen in FIG. 4 with tubular sockets 42*a* through 42*e* having slots 41*a* through 41*e*.

Figure 2:
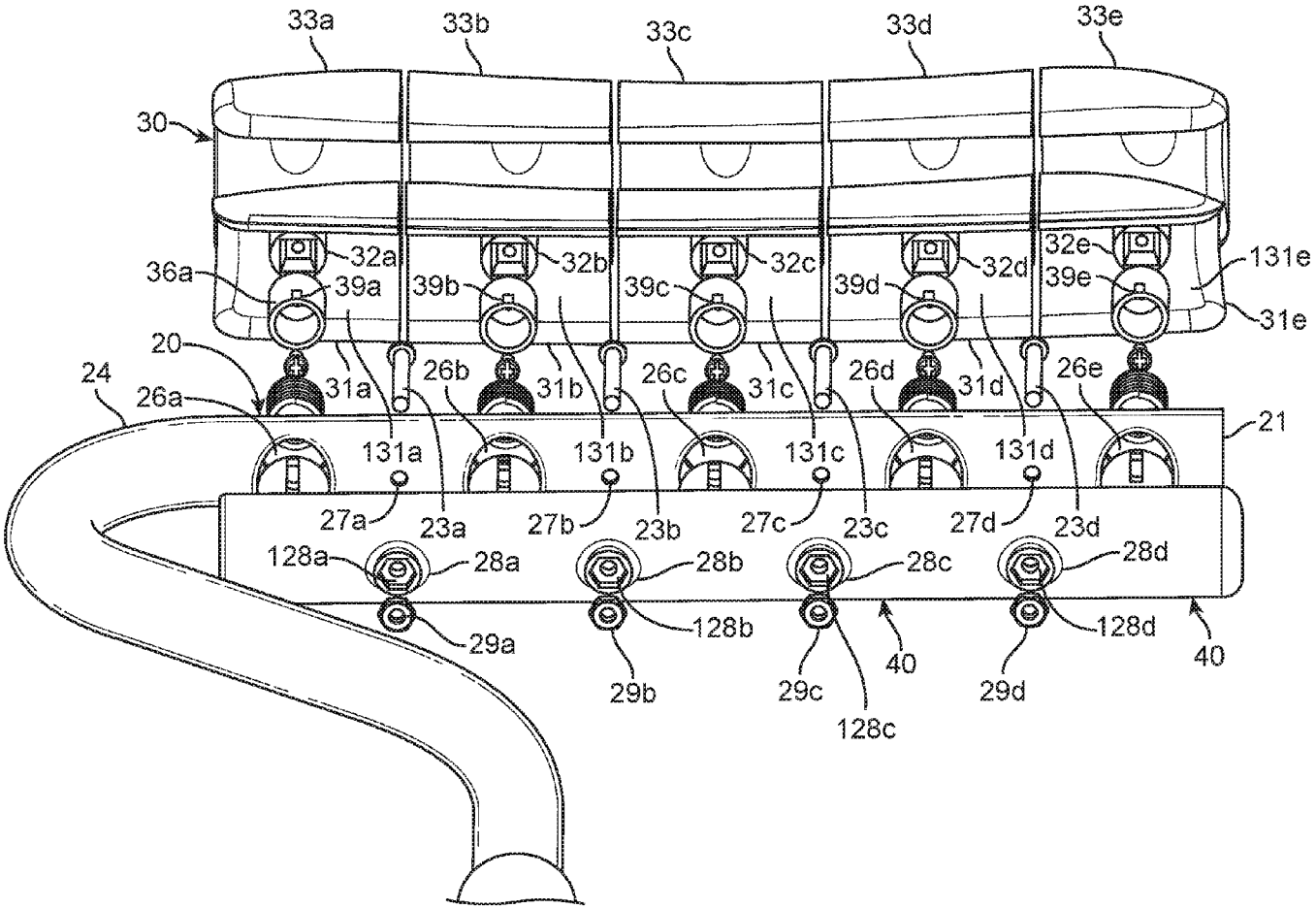
FIG. 2 shows an inclined exploded view of the embodiment shown in FIG. 1, showing the different components.
Figure 3:
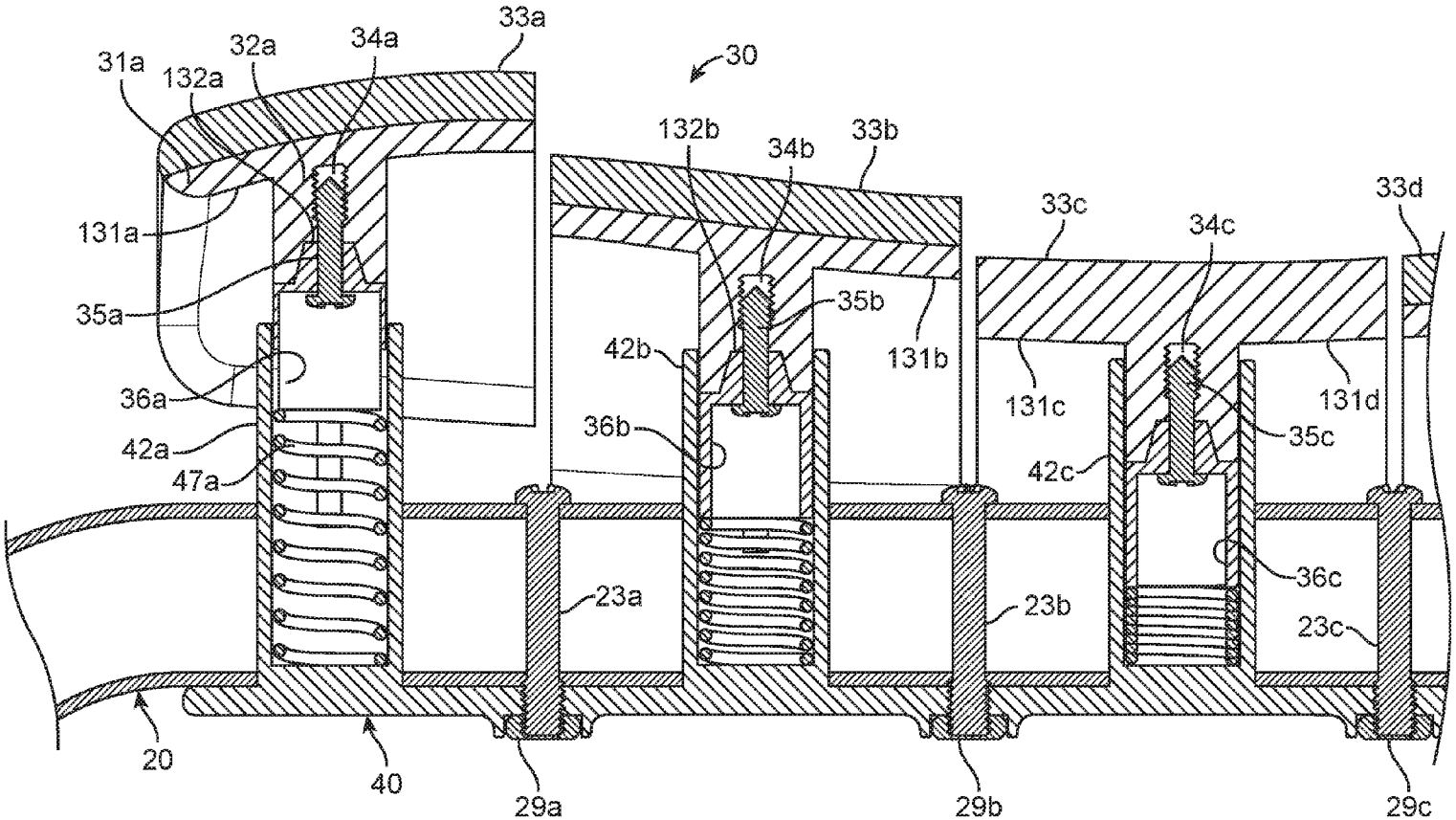
FIG. 3 is a partial cross-sectional representation of truss 20, saddle assembly 30 and support assembly 40.
Figure 3A:
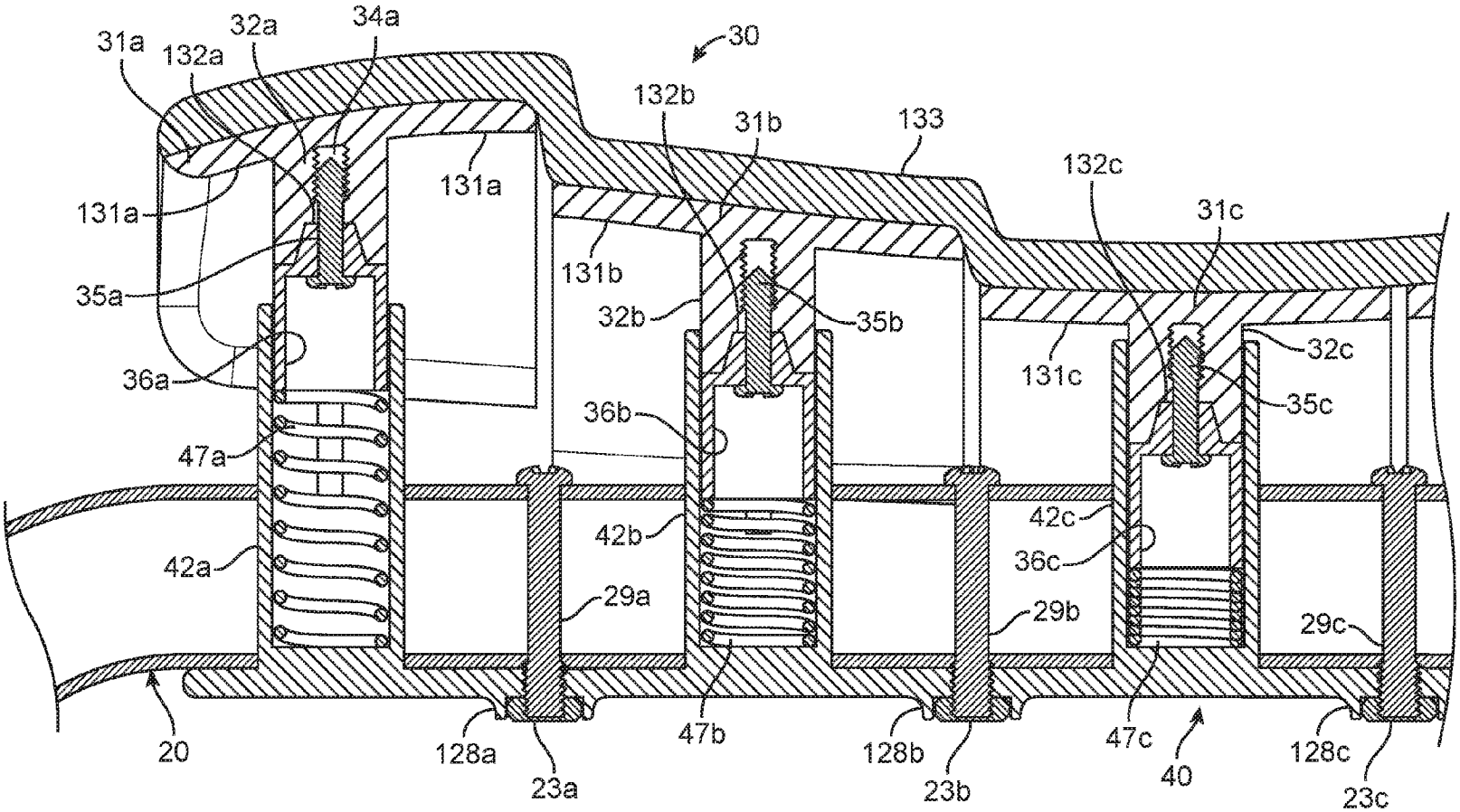
FIG. 3A is similar to FIG. 3 except that cushion 133 is continuously covering movable plates 31*a*; 31*b* and 31*c*.

Saddle assembly 30 is seen in FIG. 1 to have an ergonomic shape. As seen in FIG. 2, saddle assembly 30 includes supporting plates 31*a* through 31*e* (five of them in the embodiment shown in FIG. 2 of this application) that extend longitudinally a predetermined distance that substantially corresponds with the length of truss assembly 20, in one of the preferred embodiments. The undersides 131*a* through 131*e* of plates 31*a* through 31*e* include posts 32*a* through 32*e* that are rigidly mounted to, or integrally extend from, undersides 131*a* through 131*e*, as best seen in FIGS. 3A and 3B. Preferably, threaded holes 34*a* through 34*e* are centrally located to receive screws 35*a* through 35*e* (or equivalent fastening members). Actuating cylindrical tubes 36*a* through 36*e* are in turn abuttingly mounted, at one end, to the distal end of posts 32*a* through 32*e*. Tubes 36*a* through 36*e*, in turn, have cooperative dimensions to actuate (compress) spring members 47*a* through 47*e*, as it will be discussed below.

Figure 2A:
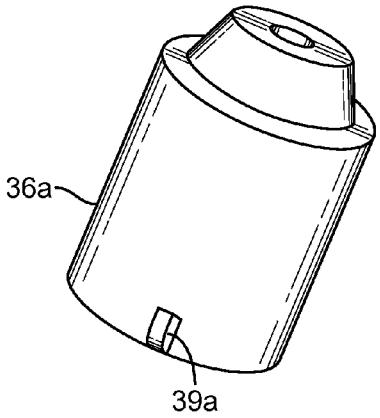
FIG. 2A illustrates an inclined isometric view of cylindrical actuating tube 36*a* with guiding pin 39*a* protruding outwardly.
Figure 2B:
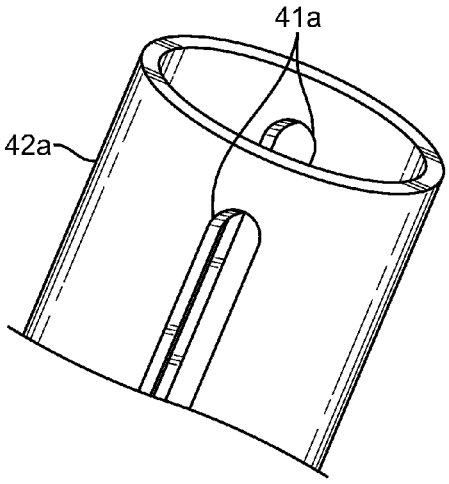
FIG. 2B shows a partial isometric view of tubular socket 42 with longitudinal slots 41.
Figure 2C:
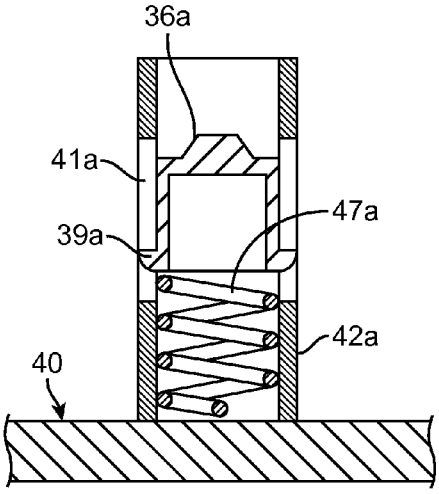
FIG. 2C is a cross-sectional view showing the disposition of tubular socket 42*a* with actuating tube 36*a* and spring member 47*a* housed therein and guiding pin 39*a* guided within slot 41.

Supporting assembly 40, as seen in FIGS. 1, 1A and 2, also extends a predetermined distance that is substantially the same as the length of arm truss assembly 20 and plates 31*a* through 31*e*. Assembly 40 has a longitudinally extending concave upperside that cooperatively receives truss assembly 20. In one of the preferred embodiments, assembly 40 is a partially longitudinal half of a tube with a semi-circular cross-section having an internal diameter that substantially matches the outer diameter of truss assembly 20. Assembly 40 includes five spaced apart tubular sockets 42*a* through 42*e* that cooperatively partially receive cylindrical actuating tubes 36*a* through 36*e*, as best seen in FIG. 2. Spring members 47*a* through 47*e* are completely housed within tubular sockets 42*a* through 42*e*, as best seen in FIGS. 3 and 3A. Sockets 42*a* through 42*e* include longitudinally extending slots 41*a* through 41*e* that receive outwardly guiding protrusions 39*a* through 39*e* of tubes 36*a* through 36*e*. Protrusions 39*a* through 39*e* of tubes 36*a* through 36*e* are cammingly inserted into sockets 42*a* through 42*e* causing a slight deflection of sockets 42*a* through 42*e* as well as tubes 36*a* through 36*e* until protrusions 39*a* through 39*e* reach guiding slots 41*a* through 41*e*. Once protrusions 39*a* through 39*e* are lodged inside slots 41*a* through 41*e*, the axial movement of tubes 36*a* through 36*e* is limited between two extreme positions. Spring members 47*a* through 47*e* are coaxially housed within sockets 42*a* through 42*e*, as best seen in FIGS. 3 and 3A. Spring members 47*a* through 47*e* can be selected with different compression constant magnitudes depending on a user's preference. For example, a user may prefer to have a softer initial approach pressure under his/her arm than on exiting, or he/she may have a more sensitive area of his/her body. Also, a heavier user may require more compression force on spring members 47*a* through 47*e* than a person with less weight. Tube 36*a*, socket 42*a* and spring member 47*a* can be best seen in FIGS. 2A; 2B and 2C. Tubes 36*a* through 36*e* include, in one of the embodiments, frustoconical end ends 38*a* through 38*e* to facilitate the engagement with counterbored ends 132*a* through 132*c* (the counterbore ends for posts 32*d* and 32*e* are not shown) having centrally located and axially extending threaded holes 34*a* through 34*e*. Screws 35*a* through 35*e* fasten tubes 36*a* through 36*e* to posts 32*a* through 32*e*. Posts 32*a* through 32*e* extend from undersides 131*a* through 131*e* to coact with the upper end of tubes 36*a* through 36*e* transmitting a portion of a user's weights applied to plates 31*a* through 31*e*. Cushions 33*a* through 33*e* are mounted to plates 31*a* through 31*e* to provide a soft and comfortable contact area with a user's underarm as shown in FIG. 3. Optionally, a continuous cover 133 is mounted over cushions 33*a* through 33*e*. Cover 133 is preferably made of an hypoallergenic material to minimize irritation to a user's underarm. In use, a user will apply a substantial portion of his/her weight to his/her underarm area that will conform to his/her preferences.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An underarm shock absorber saddle for underarm crutches, comprising:

A) an elongated arm truss assembly (20) having at least two through openings (26) said truss assembly (20) extending substantially perpendicularly from a crutch stick with a distal end (21);

B) an elongated supporting assembly (40) substantially coextensive with said truss assembly and mounted thereon and further including at least two tubular sockets (42) perpendicularly mounted to said supporting assembly (40), at a parallel and spaced apart relationship with respect to each other, and each of said sockets (42) includes a spring member (47) housed therein, said sockets (42) passing through said through openings (26);

C) a saddle assembly (30) including at least two supporting plates (31) with respective undersides (131) having at least two posts (32) perpendicularly mounted thereon at cooperative parallel and spaced apart relationship to coaxially coincide with said sockets (42) and each post (32) including a distal end (132) and further including at least two cylindrical tubes (36), each including first and second ends, said first ends being coaxially mounted to said distal ends so arranged and constructed to cause said second ends to coact with said spring members (47) upon the application of a user's weight to said supporting plates (31) thereby causing said spring members (47) to compress independently from each other.

2. The saddle set forth in claim 1 wherein said saddle assembly includes a flexible cover member covering said plates (31).

3. The saddle set forth in claim 2 wherein said spring members (47) have predetermined compression characteristics.

4. The saddle set forth in claim 3 wherein said sockets (42) include axial slots and said cylindrical tubes (36) include cooperating resilient guiding protrusions (39) lodged within said slots thereby limiting the travel of said tubes (36) with respect to said sockets (42).

* * * * *